United States Patent [19]

Maurice et al.

[11] 4,267,883

[45] May 19, 1981

[54] COOLING TOWER

[75] Inventors: Jean Maurice, St. Germain de la Grange; Raymond Quesnel, Massy, both of France

[73] Assignee: Regie Nationale des Usines Renault, Boulogne-Billancourt, France

[21] Appl. No.: 926,210

[22] Filed: Jul. 19, 1978

[30] Foreign Application Priority Data

Jul. 22, 1977 [FR] France ..... 77 22596

[51] Int. Cl.[3] ..... F24H 9/02; B01F 3/04

[52] U.S. Cl. ..... 165/129; 261/DIG. 11

[58] Field of Search ..... 261/DIG. 11, 109; 52/247; 165/DIG. 1, 47, 129

[56] References Cited

U.S. PATENT DOCUMENTS

| | | | |
|---|---|---|---|
| 3,400,917 | 9/1968 | Richards | 261/109 |
| 3,637,193 | 1/1972 | Kugler et al. | 261/DIG. 11 |
| 3,844,344 | 10/1974 | Kliemann | 165/129 |
| 3,944,636 | 3/1976 | Schuldenberg et al. | 165/129 |
| 3,987,845 | 10/1976 | Pothoff et al. | 165/129 |

FOREIGN PATENT DOCUMENTS

| | | | |
|---|---|---|---|
| 311638 | 3/1919 | Fed. Rep. of Germany . | |
| 524680 | 8/1940 | United Kingdom | 261/DIG. 11 |

*Primary Examiner*—Samuel Scott
*Assistant Examiner*—Theophil W. Streule, Jr.
*Attorney, Agent, or Firm*—Oblon, Fisher, Spivak, McClelland & Maier

[57] ABSTRACT

A cooling tower apparatus for cooling by dry and natural draft in which a battery of exchangers is shared among several independent networks fed separately by a cooling fluid, and the nominal thermal dissipation of the newtorks in operation is maintained by separation of the air flows inside the tower by means of an appropriate partition, especially by a double-shelled structure having application for the elimination of untransformed calories in electrical plants of all types, especially thermal and nuclear.

16 Claims, 9 Drawing Figures

COOLING TOWER

BACKGROUND OF THE INVENTION

1. Field of the Invention:

The present invention relates to aerorefrigerants for the dissipation of surplus calories not transformed into electricity in all types of power plants, especially thermal and nuclear. The invention in particular relates to a new process for cooling by dry method and natural draft, as well as to an appropriate tower for its implementation. It may likewise be applied to wet systems or mixed wet-dry systems.

2. Description of the Prior Art:

Dry aerorefrigerants are known in which the circuits for fluid to be cooled are totally closed, i.e., the fluid has no direct contact with the outside air, which allows, especially, installation of cooling towers on sites lacking water and avoiding the borrowing and return of water to and from the natural environment (i.e., river, sea).

Such towers are generally formed by a high rotation shell, supported at its base by a ring of oblique props topped off by a circular lintel. The heat exchangers, which may be set up in batteries with simple pipes or fitted with vanes, are supported above ground around the base of the tower by a metal grating frame, itself being supported by vertical props installed on the surface at the tower base. The outside air, coming in through the base of the tower between the support props traverses the battery of exchangers in which the primary fluid to be cooled circulates in a closed circuit.

In the case of a single network at the level of the battery of exchangers, the circuit for fluid to be cooled feeds the entire exchange surface. The installation is thus calculated as a function of this network to ensure the maximum heat dissipation corresponding to the given upward force of the hot air, seeking minimum charge losses to the air and thus a minimum shell height.

SUMMARY OF THE INVENTION

In the case of several networks for primary fluids to be cooled, independent and fed separately, with thermal exchange surfaces arranged inside a single tower, the process serving as the basis of this invention aims at maintaining dissipation of the maximum thermal flows when the feeding of one of the fluid systems is halted.

For this purpose, the invention is primarily aimed at a process for cooling by dry method and natural draft in which the battery of exchangers is shared among several independent networks fed separately by a fluid to be cooled, by which the upward force of the hot air is maintained towards the tower outlet along with the nominal thermal dissipation of the network(s) operating by separation of the air flows inside the tower.

In its simplest and most reduced form, the device for putting the procedure into operation is characterized essentially by a double-shelled dry tower, the inner shell of which is clearly concentric to the outer shell and the partitions of which delimit the independent networks at the base.

In a preferred version, the outer shell, resistant to wind, is traditionally of concrete, and the inner shell, protected by the outer shell, is formed by a taut structure much lighter than known structures which must be wind-resistant, a structure held in place by appropriate means in relation to the ground and in relation to the top ring of the outer shell.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

The present invention is directed to the sharing of a battery of exchangers by several independent networks, fed separately by the fluid to be cooled, thus permitting several operational systems. FIGS. 1*a* to 1*d* illustrate four variants for distribution, given by way of nonlimiting example.

Figure 1A:
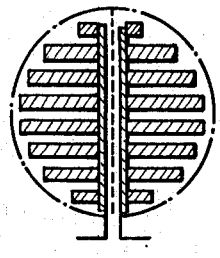
FIGS. 1*a* to 1*d*, seen in a horizontal plane of the tower, represent variants of the geometric distribution of the networks over the thermal exchange surface.
Figure 1B:
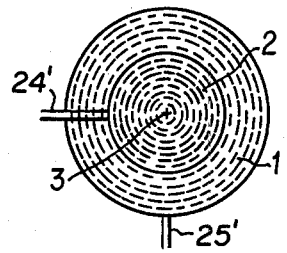
Figure 1C:
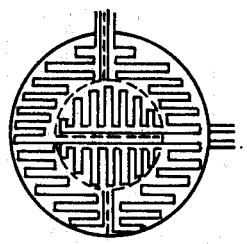
Figure 1D:
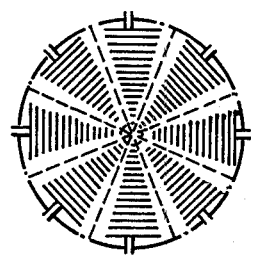

FIG. 1*a* shows two networks separated by a diameter thereof; FIG. 1*d* illustrates a bundle of eight radial networks diametrically opposed, FIG. 1*b* two networks 1, 2 (or more), concentrically oriented, in which the installation lines are represented by broken lines, around the symmetrical axis 3 of the tower, and FIG. 1*c* shows a combination based upon FIGS. 1*a* and 1*b* in which four networks are formed by two concentric surfaces separated by two diameters in quadrature. For each network, the fluid entry/exit conduits 24' 25' are schematically represented in FIG. 1*b*.

If the exchangers are identical and arranged in the same way, it will be noted that the relationship of the exchange surfaces of the networks varies as does that of the power to be dissipated.

The following description relates to the simple case of two concentric networks (FIG. 1*b*), it being understood that the principle is applicable in more complex cases of distributions.

In a dry tower, the cold air is heated as it passes through the exchangers and is then ejected out the top of the tower. The difference in temperatures existing at various points on the exchange surface determines the upward force of the air, which must be sufficient to overcome losses in charging of the whole which includes the tower shell, battery of exchangers, battery support grating, support props, and convolution of the tower base. On this upward force depend the air flow through the exchangers and thus the thermal flow ejected into the atmosphere by dry method.

When one of the two concentric networks is no longer fed by the fluid to be cooled, cold air is introduced through the unfed network, so that the unheated outside air mixes with the hot air coming out of the fed network, and the average temperature of the hot air/cold air mixture coming out of the battery is lower than the preceding case. Hence, the upward force, a function of the temperature gradient, diminishes, as does the air flow. As a consequence, the nominal thermal dissipation of the network which remains fed can no longer be ensured.

According to the essential characteristic of the procedure of the present invention, the upward force of the air and nominal thermal dissipation of the network in operation are preserved by separating the air flows corresponding to each network inside the tower. For this purpose, a tower with two concentric shells is produced in which the partitions delimit the independent networks at the base.

By way of example, FIGS. 2 to 6 illustrate three variants of the present invention in which the two shells 4, 5 are formed by rotating hyperboloid bodies, the base surfaces of which are occupied by the networks 1, 2 of the exchanger batteries on a straight cross-section of the tower at a certain height from the ground 6. Vertical props 7 support the metal grating 8 supporting the networks.

Figure 2:
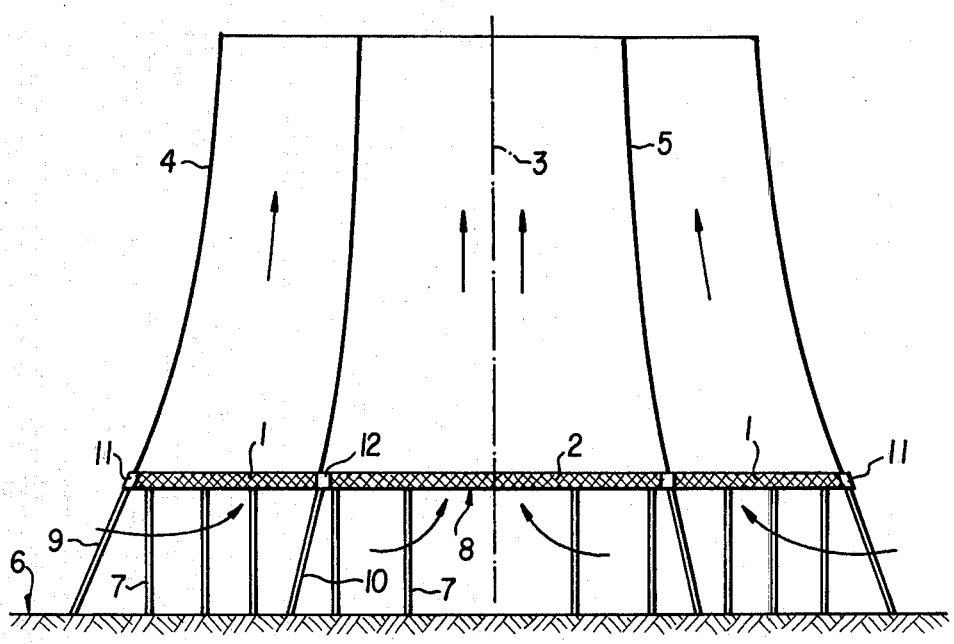
FIG. 2 represents, in elevation and in lengthwise cross section, a double-shelled tower with rigid structure.

In FIG. 2, the two shells 4, 5, both the same height, are of concrete, and each rests on a crown of oblique props 9, 10 by means of a circular lintel 11, 12. The cold air arrives, as indicated by the arrows, at the base of the tower, between the different support props, and is heated as it passes through the two concentric networks 1, 2 to be subsequently eliminated out the top of the shells. Each flow of hot air is channeled by the partitions formed by the two shells 4, 5, so that there can be no interaction between one flow and the other. Maintenance of the upward force of the hot air is thus ensured.

Figure 3:
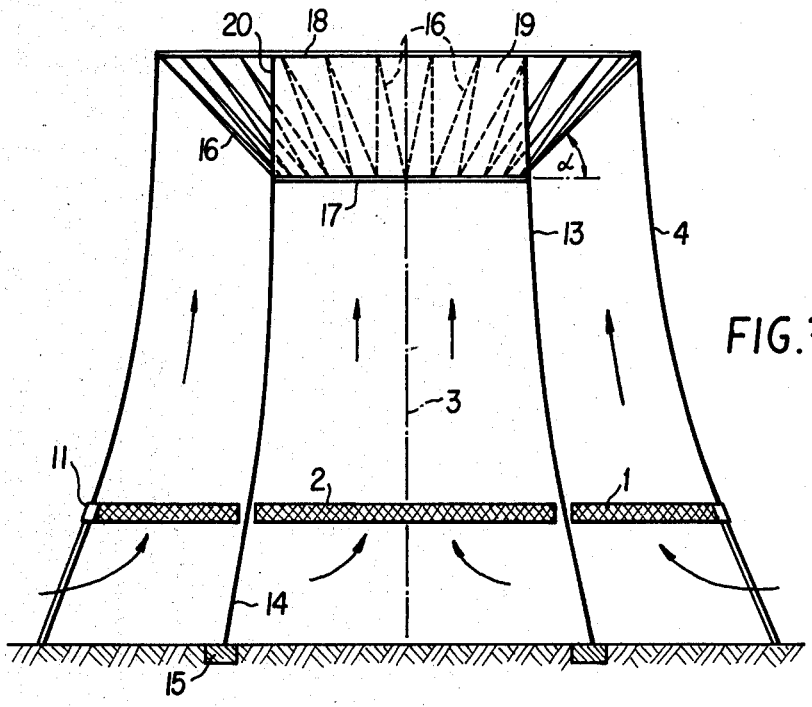
FIGS. 3 and 4 represent, in elevation and partial view from above, a double-shelled tower in which only the inner shell is a structure held in place by tie beams.
Figure 4:
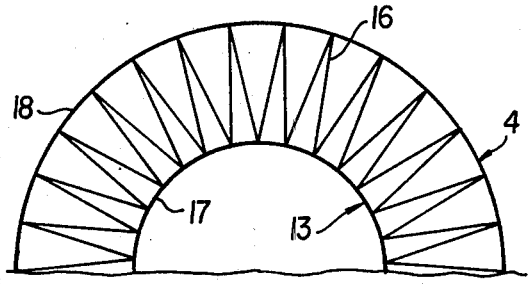

FIGS. 3 and 4 correspond to the preferred embodiment of the tower for the implementation of the method of the present invention, in which the outer shell 4 is of concrete and rests, as in the preceding case, on a ring of oblique props 14, while the inner shell 13 is formed of a structure held in place at its base and top by means of cords, cables or tie beams distributed circumferentially.

The base tie beams are solidly anchored by securing members 15 in the ground, in an extension of the structure's generators, the traction being adjustable by means of stays (not shown). The tie beams of the top join in a zigzag (FIG. 14) the top rings 17, 18 of the two shells, forming a cone-shaped body diverging towards the top, because the taut structure of the inner shell 13 is not as high as the outer shell 4.

It may be said that the inner shell is appreciably homothetic to the outer shell. The angle $\alpha$ formed by the top tie beams 16 in relation to a right section of the shell may be variable, preferably on the order of 45 degrees so as to better distribute the traction efforts supported by the rigid outer shell 4.

So as to maintain the nominal height of the inner shell 13 and hence the upward force required to dissipate the nominal thermal flow corresponding to the network 1 or 2 in operation, it is recommended that the top of the taut structure be equipped with a cylindrical or triconic collar 19 diverging towards the outlet, the height of which will be the same as the height of the outer shell 4.

This collar can be metal and rests by its own weight on the top ring 17 of the inner shell or may likewise be formed of a taut structure around a ring of vertical columns 20 attached to the inner shell.

The various taut structures may be made of any appropriate material, especially of a full cloth, PVC, Teflon, polyester or fiberglass membrane or by a reticulated membrane. In relation to two towers separated in space, the double-shell solution in which the inner shell is a light taut structure may prove to be more advantageous financially, given the fact that the inner shell may be of a more summary construction than the outer shell and need not have so much resistance to external agents, to inclement weather and especially to the action of the wind, since it is protected by the outer shell.

Figure 5:
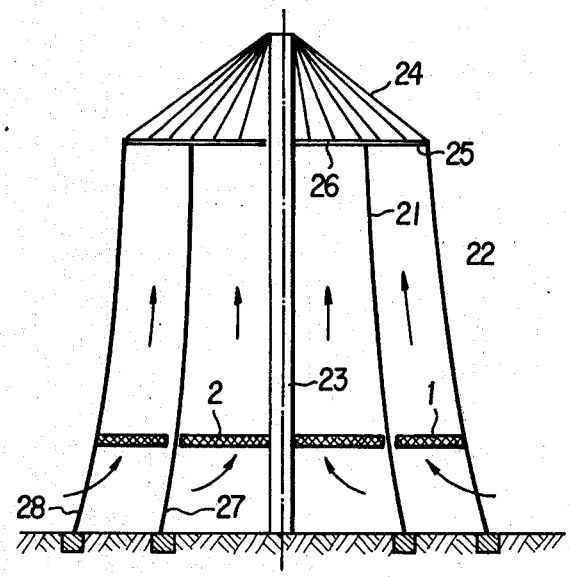
FIGS. 5 and 6 represent, in elevation and seen from above, a double-shelled tower in which both shells are formed by structures held in place around a central mast.
Figure 6:
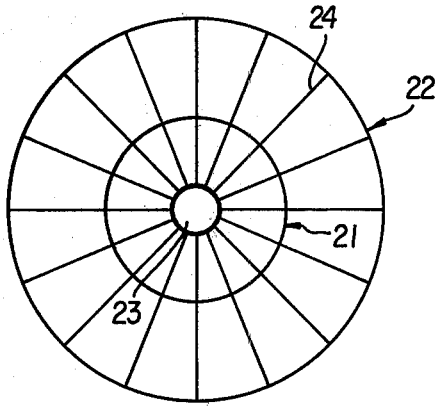

FIGS. 5 and 6 illustrate another version in which the two concentric shells 21, 22, both the same height, are formed by two full or reticulated taut structures each supported on top by a central mast 23 by means of a series of cords or tie beams 24 joined to the top rings 25, 26 of the two structures and held in place at the base by tie beams 27, 28.

In the case where some distribution other than concentric is adopted for the networks, separation of the air flows corresponding to each network will be maintained by an appropriate inner partitioning, for example by means of plane taut structures inside the outer shell or between the two concentric shells.

Obviously, numerous modifications and variations of the present invention are possible in light of the above teachings. It is therefore to be understood that within the scope of the appended claims, the invention may be practiced otherwise than as specifically described herein.

We claim:

1. A cooling apparatus which comprises:

a dry type natural draft tower including an inlet;

an outlet;

a battery of thermal exchanges arranged on a straight cross-section of the tower at the base of the tower forming a plurality of separate and independent thermal exchange networks for uniformity of heat transfer wherein said networks are concentric with relation to the symmetrical axis of the tower; and, means for separating said networks above the ground including an inner and outer concentric shell wherein said inner shell extends from and intersects said means for separating said networks.

2. A cooling apparatus according to claim 1 which further comprises:

a ring of props disposed near the base of the tower such that the outer shell consist of concrete and is mounted on said rings; and securing means distributed circumferentially at the top of the tower for supporting said inner shell.

3. A cooling apparatus according to claim 2 wherein said inner shell comprises a taut structure and said cooling tower further comprises a first and second top ring disposed on a top portion of said inner and outer shells, respectively, a plurality of tie beams interconnecting said first and second top ring, and a triconic collar member diverging outwardly towards the tower outlet interconnecting said first and second top ring resting on said first ring.

4. A cooling apparatus according to claim 1 wherein said networks are distributed on the exchange surface and comprise four networks formed by two concentric surfaces separated by two diameters in quadrature.

5. A cooling apparatus according to claim 1 which further comprises a first and second ring of support props wherein said inner and outer shells consist of concrete and each rests on said first and second ring of support props respectively.

6. A cooling apparatus according to claim 1 characterized by the fact that the outer shell is of concrete and rests on a ring of props while the inner shell is a structure held in place at its base and at its top by means of cords, cables or tie beams distributed circumferentially.

7. A cooling tower according to claim 1 wherein said networks are distributed in sectors delimited by the internal separations of the air flows according to one or several diameters of the straight section of the tower at the level of the exchangers.

8. A cooling tower according to claim 1 wherein said networks are arranged in radial bundles on the exchange surface.

9. A cooling tower according to claim 2, which further comprises:

a top ring disposed on said inner shell;

a ring of vertical column members attached to said top ring on the inner shell; and a cylindrical collar formed around said vertical column and resting on said top ring of said inner shell.

10. A cooling tower according to claim 1, which further comprises:

a first and second top ring mounted on said inner and outer shells, respectively, wherein said inner and outer shells comprise a double taut structure;

a mass member centrally located in said tower; and, means for connecting said first and second top rings.

11. A cooling tower according to claim 10, wherein said taut structure consists of full cloth.

12. A cooling tower according to claim 10, wherein said taut structure consists of PVC.

13. A cooling tower according to claim 10, wherein said taut structure consists of Teflon.

14. A cooling tower according to claim 10, wherein said taut structure consists of polyester.

15. A cooling tower according to claim 10, wherein said taut structure consists of fiberglass cloth.

16. A cooling tower according to claim 10, wherein said taut structure consists of retriculated membrane.

* * * * *